US005987298A

United States Patent [19]

Muramatsu et al.

[11] Patent Number: 5,987,298

[45] Date of Patent: Nov. 16, 1999

[54] IMAGE FORMING APPARATUS INCLUDING A TONER RECYCLING MECHANISM

[75] Inventors: Satoshi Muramatsu; Nobuo Kasahara; Takashi Hodoshima, all of Kanagawa, Japan

[73] Assignee: Ricoh Company, Ltd., Tokyo, Japan

[21] Appl. No.: 09/241,378

[22] Filed: Feb. 2, 1999

[30] Foreign Application Priority Data

Feb. 2, 1998 [JP] Japan ..... 10-020801
Mar. 31, 1998 [JP] Japan ..... 10-103523

[51] Int. Cl.[6] ..... G03G 21/10; G03G 15/08

[52] U.S. Cl. ..... 399/359; 399/260

[58] Field of Search ..... 399/109, 359, 399/263, 260, 53

[56] References Cited

U.S. PATENT DOCUMENTS 5,638,159 6/1997 Kai et al. .
5,797,074 8/1998 Kasahara et al. ..... 399/260 X
5,815,784 9/1998 Kasahara et al. .
5,909,609 6/1999 Yahata et al. ..... 399/263 X

FOREIGN PATENT DOCUMENTS 5-27650 2/1993 Japan .
9288397 11/1997 Japan .
10-20636 1/1998 Japan .
10-26875 1/1998 Japan .
10-49025 2/1998 Japan .
10-69167 3/1998 Japan .

*Primary Examiner*—Susan S. Y. Lee
*Attorney, Agent, or Firm*—Oblon, Spivak, McClelland, Maier & Neustadt, P.C.

[57] ABSTRACT

In an electrophotographic image forming apparatus including a toner recycling mechanism, a collected toner conveying device is free from troubles particular to a conventional device using a screw pump and an air pump and conveying toner and air mixture via an elastic tubing, i.e., the wear of a stator due to aging and a decrease in the delivery pressure of the pump ascribable to the wear. A control device controls, based on the cumulative operation time, an operation of the screw pump and an operation of the air pump. This provides the toner conveying device with durability, reliability and simple construction while insuring toner conveyance and reducing cost.

12 Claims, 12 Drawing Sheets

IMAGE FORMING APPARATUS INCLUDING A TONER RECYCLING MECHANISM

BACKGROUND OF THE INVENTION

The present invention relates to a printer, facsimile apparatus, copier or similar electrophotographic image forming apparatus using a developer in the form of toner or a toner and carrier mixture. More particularly, the present invention relates to a toner recycling mechanism included in an image forming apparatus for collecting and conveying toner removed by a cleaning device.

An image forming apparatus of the kind described often includes a toner recycling mechanism for collecting and conveying toner removed from a photoconductive element or similar member by a cleaning device for recycling it or for disposing of it.

Generally, a collected toner conveying device is constructed to transfer the toner collected by the cleaning device to either one of a developing device or a collected toner storing device arranged independently of the cleaning device. The collected toner conveying device may include a tubing connecting the toner outlet of the cleaning device to the collected toner storing device. The tubing has a coil screw thereinside for conveying the collecting toner to the storing device. Alternatively, the storing device may be positioned in the vicinity of the toner outlet of the cleaning device, so that the collected toner may be transferred to the storing device mainly by gravity.

To convey a developer, toner or similar powder, use may be made of a screw, a paddle or a bucket in relation to a developing section or a toner feeding section included in the developing device. Alternatively, use may be made of a screw pump generally referred to as a Mono pump and capable of transferring powder without resorting to a coil screw.

However, the conventional tubing and coil screw scheme has the following problems (1)–(8) left unsolved.

(1) The coil screw must be extended to a position close to the toner storing device or the developing device.

(2) To insure the rotation of the coil screw, the toner transfer path should preferably be linear or gently curved, i.e., it should not be sharply bent. This limits the layout and makes it difficult to design the apparatus. Further, the collected toner storing device should preferably be positioned below the toner outlet of the cleaning device, further limiting the layout of the apparatus.

(3) A heavy frictional load acts between the coil screw and the tubing and increases the torque necessary for the rotation of the coil screw. This limits the distance over which the collected toner can be conveyed, renders the construction bulky, and complicates the construction of the apparatus.

(4) It is difficult to insure durability and to promote easy maintenance.

(5) Due to the limitation on the position of the collected toner conveying device, the apparatus body is increased in overall size, sophisticated in construction, and increased in cost.

(6) The toner storing device or the developing device must be arranged substantially integrally with the cleaning device, limiting the position of the device as to mounting and limiting the amount of toner that can be stored. As a result, the collected toner conveying device is applicable only to a low speed machine and a user-oriented copier/printer expected to produce only a small number of copies or printings.

(7) The capacity, configuration, material and so forth of the collected toner storing device have critical influence on the manual operation relating to toner collection, maintenance, and delivery cost of the collected toner from the user to the manufacturer.

On the other hand, the screw pump scheme is attracting increasing attention and can implement a toner collecting and conveying device free from the problems of the above coil screw and tubing scheme. Specifically, the screw pump provides the developing device and therefore the apparatus body with an adequate size and insures the quality, performance and function of the cleaning device.

However, the problem with the screw pump is that a stator included therein is formed of rubber and caused to wear or creep by a rotor contacting it due to aging. Consequently, the amount of bite of the rotor and stator into each other and the degree of close contact decrease, lowering the delivery pressure of the screw pump. The stator is therefore a part to be replaced and increases the service cost.

Technologies relating to the present invention are disclosed in, e.g., Japanese Patent Laid-Open Publication Nos. 9-288397, 10-69167, 10-49025, 10-26875, 10-20636, and 5-27650.

SUMMARY OF THE INVENTION

It is therefore an object of the present invention to provide an image forming apparatus including a toner recycling mechanism capable of solving the problems discussed above.

An image forming apparatus including an image carrier and capable of recycling toner of the present invention includes a screw pump including a female screw type stator formed with a spiral groove in its inner periphery and a male screw type rotor rotatably received in the stator. An air feeding device scatters and thereby fluidizes collected toner to be delivered from the screw pump via a tubing. A drive source selectively starts or stops driving the screw pump independently of the image carrier. A timer counts the cumulative operation time of the image carrier. A controller controls, based on the cumulative operation time, the operation of the screw pump and that of the air feeding device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
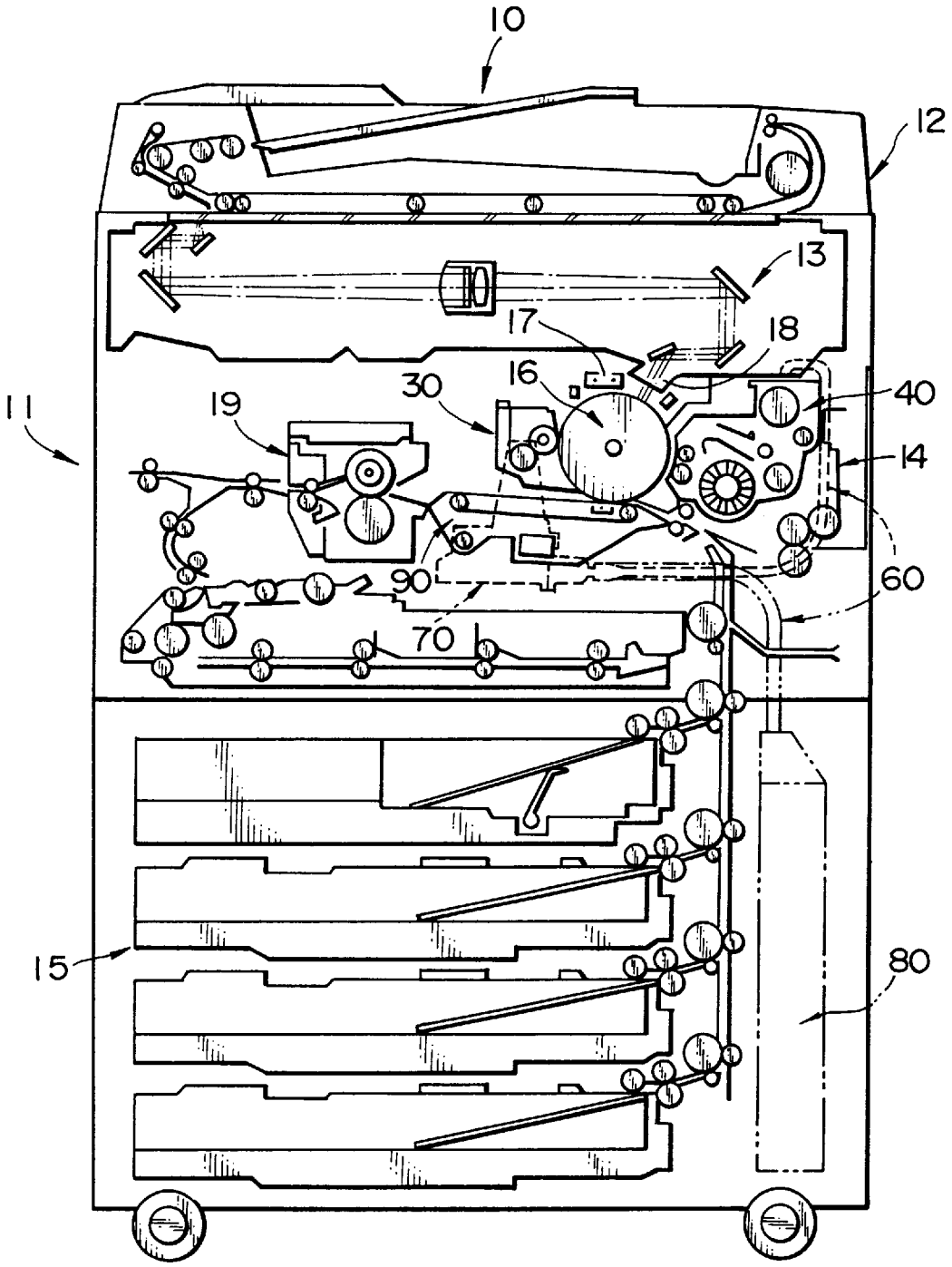
FIG. 1 is a section showing an image forming apparatus embodying the present invention.

Referring to FIG. 1 of the drawings, an image forming apparatus embodying the present invention is shown and implemented as an electrophotographic copier by way of example. As shown, the copier, generally 10, is generally made up of a copier body 11 and an ADF (Automatic Document Feeder) 12. The copier body 11 includes optics 13 for reading a document, an image forming section 14, a paper feeding section 15, and a toner recycling mechanism. The image forming section 14 includes a photoconductive element or image carrier implemented as a drum 16, a charger 17, an exposing section 18, a developing unit 40, an image transferring device 90, a fixing unit 19, and a cleaning unit 30. In the illustrative embodiment, the cleaning unit 30 includes a cleaning blade.

The toner recycling mechanism includes a tubing 60 communicating the cleaning unit 30 and image transferring device 90 to the developing unit 40 (or a collected toner storing device 80) via a collected toner conveying device 70. In the illustrative embodiment, the collected toner conveying device 70 is implemented by a powder pump unit, as will be described specifically later. Toner collected from the drum 16 by the cleaning unit 30 is transferred to the developing unit 40 or the collected toner storing device 80 by the tubing 60. The collected toner storing device 80 is a single unit removably mounted to the copier body 11.

Figure 2:
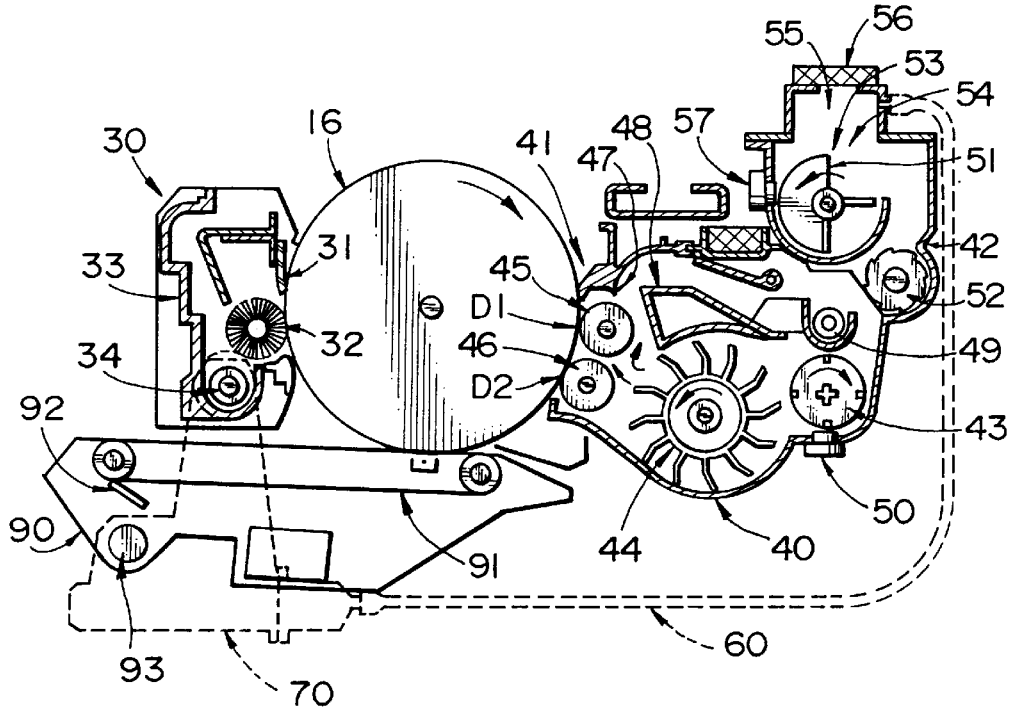
FIG. 2 is a sectional front view showing a photoconductive element and arrangements therearound.
Figure 3:
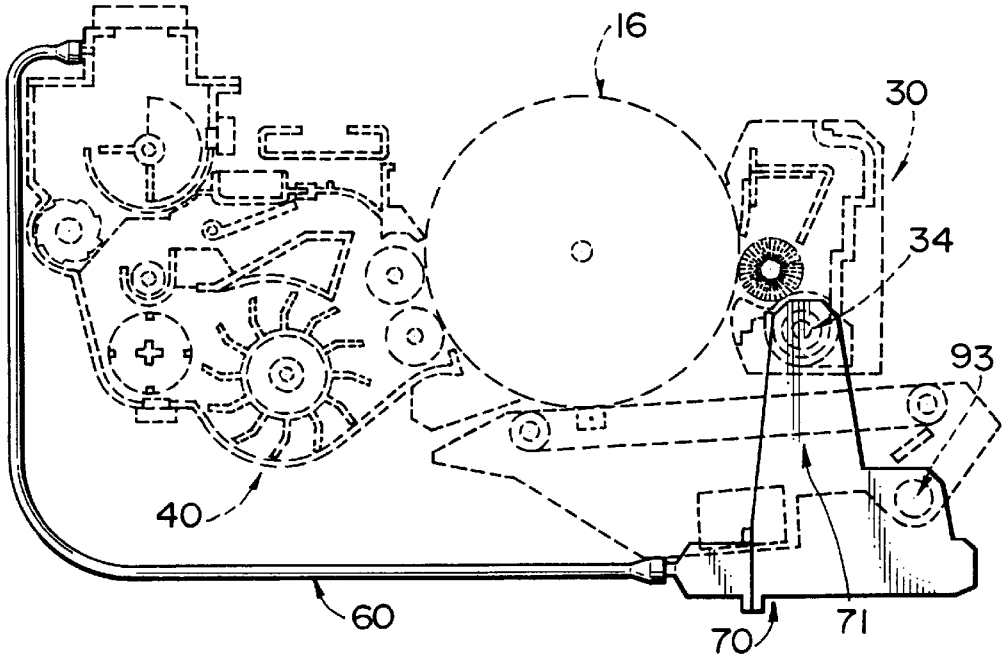
FIG. 3 is a section view showing the photoconductive element and arrangements of FIG. 2 as viewed from the back.

As shown in FIGS. 2 and 3 in detail, the cleaning unit 30 includes a blade 31 and a brush 32. The blade 31 and brush 32 remove, or collect, toner left on the drum 16 after image transfer. The collected toner is introduced into a receptacle 33 playing the role of a structural body of the cleaning unit 30 and the role of a toner guide member at the same time. A collected toner discharge member 34 is positioned at the bottom of the receptacle 33 for conveying the above toner to a hopper 71 forming a part of the collected toner conveying device 70.

The image transferring device 90 includes a belt 91 and transfers a toner image from the drum 16 to a paper or similar recording medium while conveying the paper. The belt 91 remains in contact with the drum 16 via a paper at least during the conveyance of the paper, so that toner is sometimes transferred from the drum 16 to the belt 91. A cleaning blade 92 removes such toner deposited on the belt 91. A collected toner discharge member 93 drives the toner collected by the cleaning blade 92 to the outside of the image transferring device 90.

As shown in FIG. 2, the developing unit 40 includes a developing section 41 and a toner replenishing section 42. In the illustrative embodiment, the developing unit 40 stores a toner and carrier mixture, i.e., two-ingredient type developer. The developing section 41 has a roller 43 and a paddle wheel 44 serving as agitating members, and a plurality of (two in the illustrative embodiment) developing rollers or developer carriers 45 and 46. A drive section, not shown, causes the roller 43 and paddle wheel 44 to rotate and convey the developer existing in the developing section 41 while agitating it. The agitation charges the toner and carrier of the developer to opposite polarities.

The developing rollers 45 and 46 adjoin the drum 16 and are respectively positioned at the upstream side and downstream side in the direction of rotation of the drum 16. The developing rollers 45 and 46 each is made up of a stationary magnet roller and a sleeve surrounding it and driven by a drive section not shown.

In the developing section 41, the paddle wheel 44 conveys the developer to the developing roller 46. The developing roller 4 magnetically retains the developer thereon and conveys it to the developing roller 45. The developing roller 45 magnetically holds the developer conveyed thereto by the developing roller 46 and paddle wheel 44 and conveys it to a developing position D1 where the roller 45 faces the drum 16. The developer on the developing roller 45 develops a latent image electrostatically formed on the drum 16 when brought to the position D1.

The developing roller 46 faces the drum 16 at a developing position D2. At the position D2, the developer on the developing roller 46 further develops the latent image having been developed by the developer at the position D1. The developer remaining on the developing roller 46 after the development drops into the developing section 41 and is agitated by the paddle wheel 44. A doctor blade 47 scrapes off an excessive part of the developer deposited on the developing roller 45. This part of the developer is guided by a separator 48 to a screw conveyor 49 and dropped onto the roller 43 thereby.

A toner content sensor 50 is positioned in the vicinity of the roller 43 in order to sense the toner content of the developer existing in the developing section 41. The toner replenishing section 42 replenishes toner to the developer present in the developing section 41. The toner replenishing section 42 includes an agitator 51 for agitating the toner, and a replenishing roller 52 driven to replenish the toner to the developing section 41 in accordance with the output of the toner content sensor 50. An opening 53 and a connecting section 54 for the replenishment of collected toner are formed in the upper portion of the toner replenishing section 42.

The collected toner conveying device 70 conveys the collected toner to the toner replenishing section 42 via the tubing 60 and the connecting section 54 connected to the end of the tubing 60. The toner replenishing section 42 further includes an air vent 55 and an air filter 56. The collected toner is conveyed to the replenishing section 42 by air under pressure. The air vent 55 prevents pressure inside the toner replenishing section 42 and developing section 41 from rising.

A toner end sensor 57 senses the amount of toner remaining in the toner replenishing section 52 in order to detect a toner end condition or a toner near-end condition. The toner end sensor 57 is implemented by a piezoelectric device responsive to the pressure of toner being replenished from the replenishing section 52 to the developing section 41. When the pressure of the toner stops acting on the toner end sensor 57, the sensor 57 outputs a toner end signal or a toner near-end signal. In response to the toner end or toner near-end signal, toner feeding device, not shown, separate from the developing device feeds fresh toner to the replenishing section 42.

When the replenishing roller 52 is driven, it rotates the agitator 51 via a gearing not shown. The agitator 51 conveys the toner from the front to the rear in the direction perpendicular to the sheet surface of FIG. 2 to the replenishing roller 52. The replenishing roller 52 is formed with grooves for conveying the toner.

Figure 4:
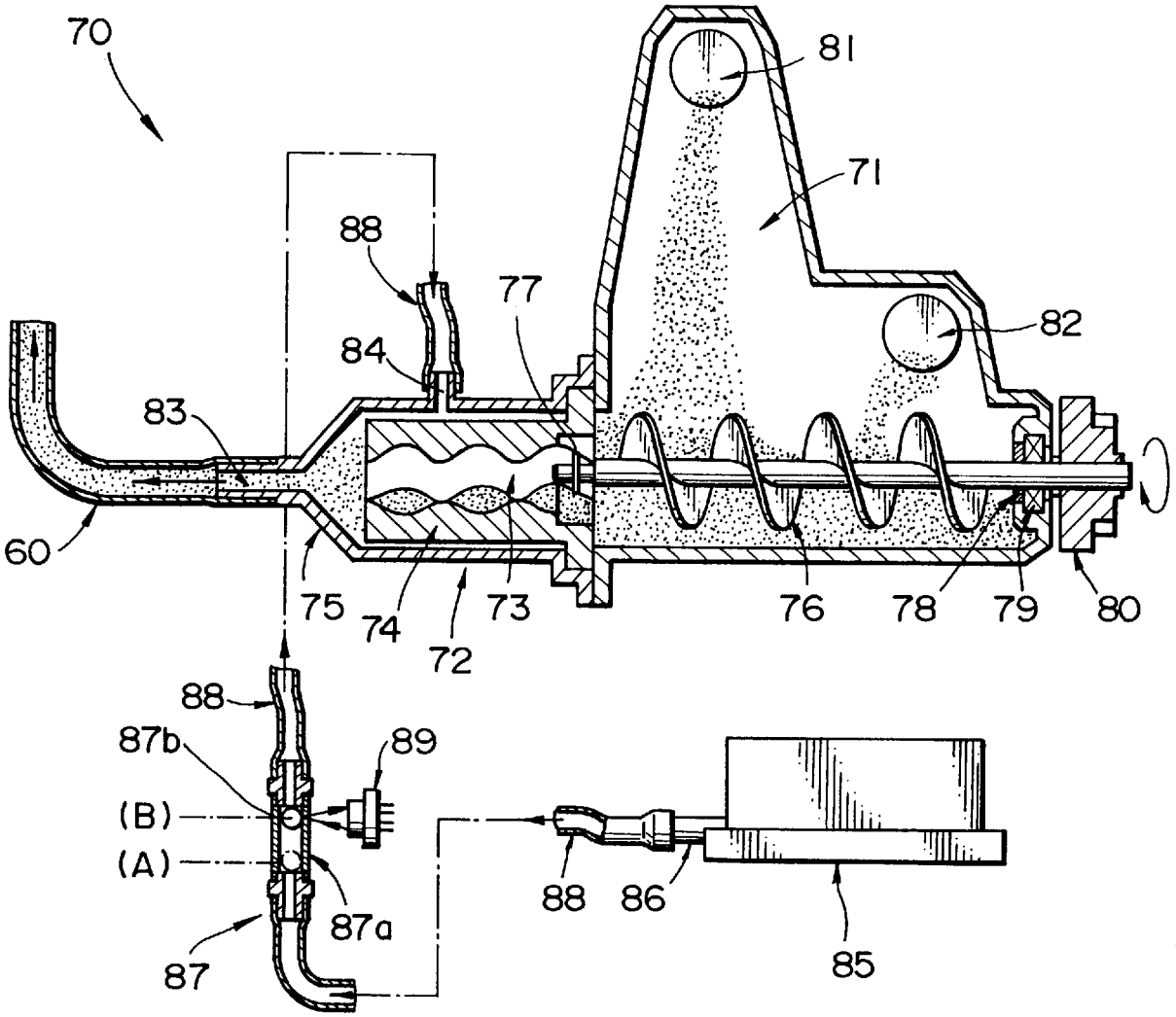
FIG. 4 is a section showing a collected toner conveying device representative of a modification of the illustrative embodiment.

As shown in FIG. 4, the collected toner conveying device 70 is implemented by a powder pump unit 72 generally referred to as a Mono pump. The powder pump unit 72 is a screw pump unit made up of a male screw type rotor 73 and a female screw type stator 74 surrounding the rotor 73 and formed of rubber or similar elastic material. A holder 75 holds the stator 74. The stator 74 is formed with a single pitch or double pitch spiral groove in its inner periphery.

A horizontal screw conveyor 76 has its one end connected to the rotor 73 by a pin 77. The other end of the screw conveyor 76 is connected to a driven gear 80 via a seal member 78 and a bearing 79. The driven gear 80 is driven by either one of a main motor included in the copier body and an exclusive motor, i.e., drive means independent of the main motor.

The hopper 71 is formed with openings 81 and 82. The toner discharged by the toner discharge member 34 of the cleaning unit 30 and the toner discharged by the toner discharge member 93 of the image transferring device 90 are introduced into the hopper 71 via the openings 81 and 82, respectively. Such toner is guided to the bottom of the hopper 71 and temporarily stored there in a preselected amount.

A gap of about 1 mm exists between the outer periphery of the stator 74 and the inner periphery of the holder 75 and is communicated to a passageway 83. The holder 75 is formed with an air inlet 84. An air pump or air feeding device 85 is positioned outside of the holder 75 and includes an air outlet 86. The outlet 86 is communicated to the air inlet 84 via a conduit 88 and an air sensor 87. In this configuration, air under pressure is fed from the air pump 85 to the air inlet 84 and therefore to the passageway 83.

The air pump 85 sends compressed air into the collected toner via the air inlet 84 at a rate of 0.5 to 1 litter per minute. As a result, the fluidity of the collected toner to be delivered from the powder pump unit 72 is enhanced. This allows the powder pump unit 72 to more surely convey the collected toner.

The collected toner coming out of the powder pump unit 72 is sent to the developing unit 40 or the collected toner storing device 80 by the tubing 60. The tubing 60 is implemented by a tube having an inside diameter of, e.g., about 4 mm to 6 mm and a thickness of about 1 mm to 2 mm. The tubing 60 does not have to be provided with any member thereinside and can therefore be formed of a flexible material. For example, use may advantageously be made of soft vinyl chloride, nylon or Teflon that is flexible and highly resistive to toner. Because the tubing 60 connecting the copier body and toner replenishing device is flexible, the various units can be laid out with a minimum of limitation. This successfully promotes the effective use of the limited space available in the copier and easy maintenance.

Further, in the illustrative embodiment, the tubing 60 and the conduit 88 extending from the air pump 85 may each be implemented by a plurality of parts connected together. This configuration facilitates the construction of the individual device into a unit and enhances productivity and easy maintenance.

The distance of conveyance of the collected toner can be freely selected on the basis of the size of the rotor 73, the size of the stator 74, and the rotation speed of the rotor 73. In addition, the collected toner can be conveyed in any desired direction, i.e., upward, downward, rightward or leftward. This kind of conveying device is therefore far more advantageous over the conventional conveying device that simply drops collected toner vertically downward.

The prerequisite with the above conveyance using the powder pump unit 72 is that the collected toner be conveyed together with air from the reliability standpoint. The air sensor 87 is used to determine whether or not air is being adequately fed from the air pump 85 to the powder pump unit 72. The air sensor 87 plays the role of a safety device for minimizing the system-down of the toner collecting device.

As shown in FIG. 4, the air sensor 87 has a transparent tubular container 87*a* and a float 87*b* sealed in the container 87*a* in such a manner as to be movable up and down. When the air pump 85 is operated to deliver compressed air via the air sensor 87 in the direction indicated by a narrow in FIG. 4, it raises the float 87*b* from a position (A) to a position (B). A reflection type or transmission type photosensor or similar sensor 89 senses the float 87*b* brought to the position (B) and shows that air is being adequately sent from the air pump 85 to the powder pump unit 72.

Assume that the float 87*b* is absent at the position (B) despite the operation of the air pump 85, as determined by the sensor 89. Then, a controller, not shown, determines that some error has occurred in the delivery of air from the air pump 85 to the powder pump unit 72, and stops the operation of the copier body 11 while displaying an error message on the copier body 11.

While the float 87*b* of the illustrative embodiment is implemented by a ball formed of resin or stainless steel or similar metal, it may, of course, be implemented by any other suitable member and formed of any other suitable material. The reflection type or transmission type sensor 89 may be replaced with, e.g., a magnetic sensor.

To convey a greater amount of collected toner, it has been customary to increase the size of a coil screw and that of a tubing and to increase the rotation speed of the coil screw. Further, to increase the distance of conveyance, it has been customary to connect a plurality of coil screws and tubes. This, however, increases the number of parts and cost, degrades reliability, maintenance and productivity, increases the size of a conveying device and therefore the overall size of an apparatus body, and increases the area to be occupied by the apparatus body.

By contrast, in the illustrative embodiment, the flexible tubing 60 should only be connected to the developing device 40 or the collected toner storing device 80, so that the toner collecting device can be implemented as a miniature independent unit. The toner collecting device can therefore be mounted to the copier body with a minimum of limitation and reduces the area to be allocated to the copier body. In addition, such a toner collecting device enhances the productivity of the copier body and easy maintenance.

Moreover, the collected toner is conveyed via the tubing 60 together with compressed air. This substantially frees the collected toner from mechanical stresses and frees the tubing 60 from drive loads. The toner collecting device therefore is capable of surely conveying the collected toner and is free from limitations relating to the distance and direction of conveyance. In addition, the above embodiment enhances the reliability and durability of the toner collecting device, simplifies the configuration of the toner collecting device, and reduces the drive load and therefore power consumption and cost.

Hereinafter will be described a modification of the above embodiment also implemented as an image forming apparatus of the type including screw pump means and air feeding means for fluidizing collected toner being conveyed by the screw pump means. Briefly, the modification includes drive means or drive transmitting means for selectively starting or stopping the operation of the screw pump means independently of the image carrier, a controller for feeding a drive signal to the drive means, and counting means for counting the cumulative operation time of the image carrier. The screw pump means is driven in accordance with the output of the counting means. With this configuration, the modification drives the screw pump means only for a minimum necessary period of time in accordance with the duration of image forming operation and thereby promotes efficient pump drive.

Specifically, in the modification, the toner collecting device is driven by either one of a main motor or main drive source, not shown, included in the copier body 11 for driving, e. g., the drum 16 and an exclusive motor, not shown, independent of the main drive source. In the case where the main drive source is used, a clutch or similar drive transmission mechanism intervenes between the drive source and the toner collecting device. When the drum or image carrier 16 is used over a preselected period of time, a main control board included in the copier body 11 turns on the clutch or the exclusive motor of the toner collecting device by sending a control signal thereto. At this instant, when the drive clutch or the exclusive motor is turned on, only the air pump 85 is turned on. Then, on the elapse of a preselected period of time, the drive clutch or the exclusive motor is turned off, but only the air pump 85 is continuously operated for several more seconds.

The above control is advantageous for the following reasons. While the powder pump unit 72 is operation, the collected toner substantially uniformly mixed with air fills substantially the entire tubing 60. If the entire copier, i.e., the powder pump unit 72 and air pump 85 are turned off at the same time, then only air contained in the toner and air mixture filling the tubing 60 flows out. As a result, the toner drops due to its own weight and increases its density within the tubing 60.

In the above condition, when the powder pump unit 72 is again operated to deliver the collected toner, it is likely that the dense toner existing in the tubing 60 blocks the toner newly coming into the tubing 60. Consequently, the powder pump unit 72 locks or causes the collected toner to stick to the rotor 73 thereof due to excessive temperature elevation. The toner stuck to the rotor 73 shaves off the stator 74 and thereby damages the powder pump unit 72.

By contrast, when only the air pump 85 is driven before the start of operation of the powder pump unit 72, the dense toner existing in the tubing 60 is driven out by air. Alternatively, only the air pump 85 may be driven after the stop of operation of the powder pump unit 72 in order to substantially evacuate the tubing 60. In this manner, the tubing 60 is prevented from being stopped and can surely convey the collected toner.

Figure 5:
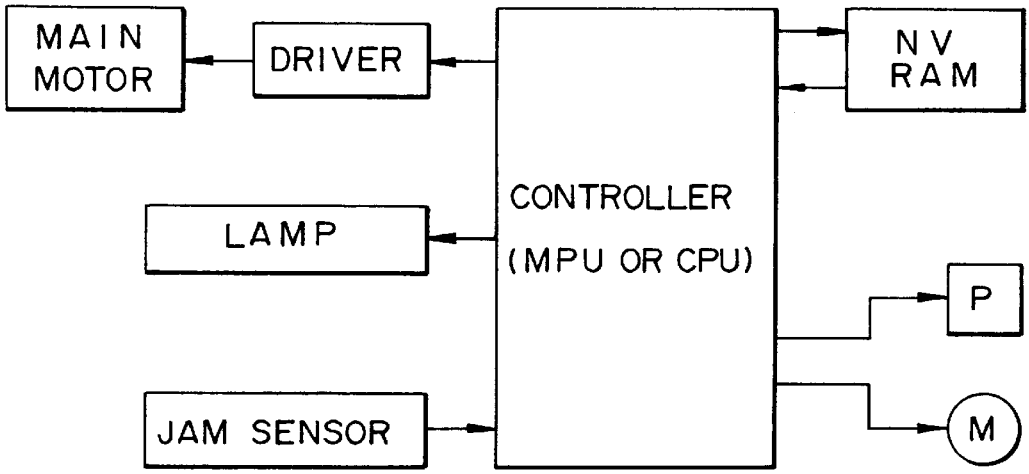
FIG. 5 is a block diagram schematically showing a control system included in the illustrative embodiment.

FIG. 5 shows a control system for executing the above control. As shown, a controller including an MPU (Micro Processing Unit) or a CPU (Central Processing Unit) controls the toner collecting device. Assume that the powder pump unit 72, not shown, is driven by the main motor of the copier body via a clutch. The MPU has a timer function and is capable of controlling each of the ON/OFF of the clutch or drive transmitting means and that of the air pump 85, not shown, at any desired timing.

Figure 6:
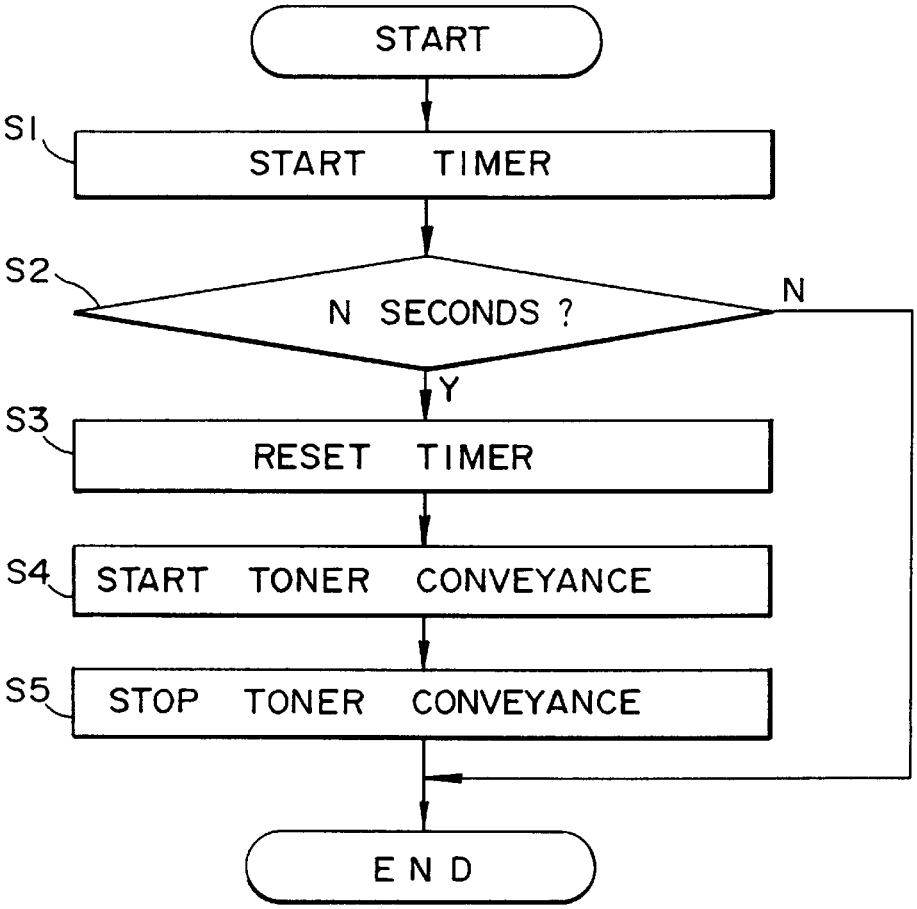
FIG. 6 is a flowchart demonstrating a specific operation of the control system.

A specific operation of the MPU will be described with reference to FIG. 6. As shown, the MPU counts and stores the cumulative drive time of the drum 16, not shown, with a timer (steps S1–S3). When the drive time reaches a preselected value N, the MPU clears the timer and turns on the clutch (M, FIG. 5) of the toner collecting device to thereby start driving the air pump (P, FIG. 5). In step S4, the conveyance of toner continues from the start to the end of operation of the air pump and from the coupling to the uncoupling of the clutch M associated with the powder pump unit. An NV RAM (Non Volatile Random Access Memory) should preferably be provided for preventing the value of the timer from being cleared when the power supply is shut off.

Figure 7:
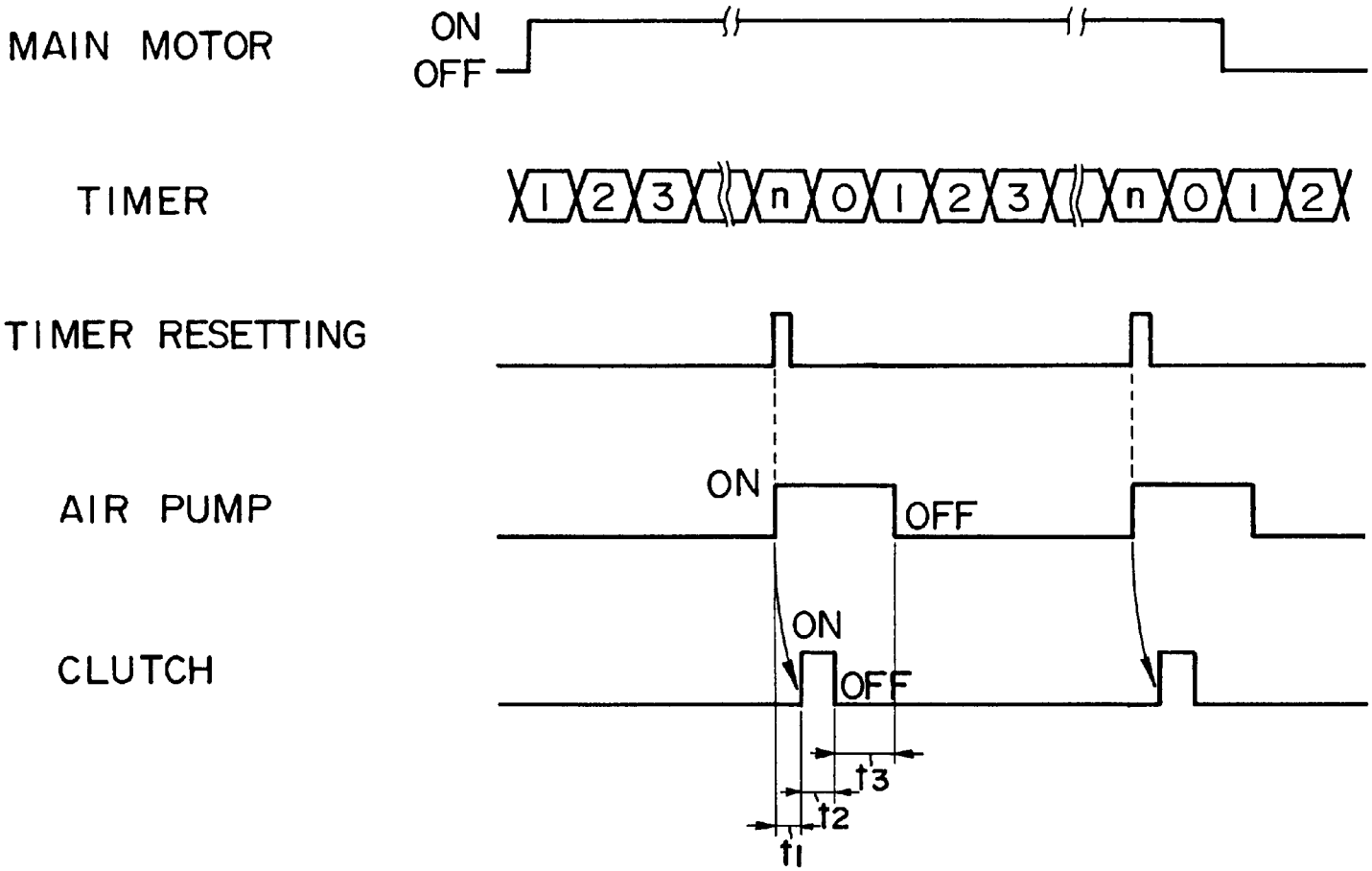
FIG. 7 is a timing chart showing the operation timing of a drive motor and that of an air pump included in the illustrative embodiment.

FIG. 7 shows specific control over the powder pump unit and air pump in detail. As shown, when the cumulative drive time of the main motor reaches the preselected value N, the air pump is caused to start operating. The clutch for driving the toner collecting device is coupled on the elapse of a period of time t1 (e.g. 0.5 seconds) since the start of operation of the air pump. Then, on the elapse of a preselected period of time t2 (e.g. 2 seconds), the clutch is uncoupled. When a preselected period of time t3 (e.g. 4 seconds) expires since the uncoupling of the clutch, the air pump for toner collection is turned off. As a result, air can discharge the toner remaining in the tubing 60 alone, as stated earlier.

The cumulative drive time N can be adequately selected by calculation. Specifically, the amount of toner collected from the drum (main motor) is determined on the basis of the amount of toner to deposit on the drum for a unit period of time during image formation, an image transfer ratio, etc. The ratio of the amount (ability) of toner conveyance effected by a single drive of the screw pump to the above amount of toner collected from the drum is the value N to be set.

Another modification of the illustrative embodiment will be described hereinafter. Briefly, this modification includes exposure adjusting means built in, e.g., the controller. The exposure adjusting means is capable of adjusting a voltage to be applied to a lamp that forms a latent image on the drum. The time when the screw pump should start operating is corrected in accordance with the value adjusted by the exposure adjusting means. The modification therefore successfully enhances accurate decision on the amount of collected toner and increases the efficiency of screw pump drive. This increases the durability of the screw pump and prevents collected toner from overflowing the screw pump or bridging due to a temporary increase in the amount of the toner. That is, the interval between the operations of the screw pump is adjusted in accordance with the size of the voltage to be applied to the lamp so as to achieve the above advantages.

This modification will be described specifically with reference to FIG. 5 as well as to the other drawings. The exposure adjusting means included in, e.g., the controller applies to the lamp one of a plurality of stepwise voltages selected by the operator. The controller effects toner conveyance (operation of the powder pump and that of air pump) at preselected intervals in accordance with the above voltage. For example, when the voltage is low, the controller reduces the above interval because the amount of toner to deposit on the drum and therefore to be collected increases. That is, the cumulative drive time N is replaced with a shorter drive time N1 (N1<N) in order to increase the frequency of toner conveyance. Conversely when the voltage is high, the controller increases the interval because the amount of toner to be collected decreases, i.e., replaces the cumulative drive time N with a longer drive time N2 (N2>N) in order to reduce the frequency of toner conveyance.

This modification further increases the drive efficiency of the powder pump and thereby prevents the toner from bridging or overflowing the hopper 71. Only if the amounts of toner deposition each corresponding to a particular voltage to be applied to the lamp are known beforehand, the amounts of toner collection can be determined on the basis of the image areas of documents and image transfer ratios. This allows the drive times N1 and N2 to be determined by calculation. As for the image areas, use may be made of image ratios ranging from 6% to 30% particular to papers of size A4 which are used more often that the other papers. The exposure adjusting means may be provided independently of the control device, if desired.

In a further modification of the illustrative embodiment, when a paper jams a transport path formed in the copier body, the screw pump is driven continuously or at preselected intervals. This enhances accurate decision on the amount of collected toner, simplifies the construction and reduces the cost of the toner collecting device, and prevents toner from overflowing the screw pump or bridging therein.

Specifically, jam sensors have customarily been arranged in an image forming apparatus. However, when a paper jams a transport path at the upstream side of an image transfer position, toner deposited on an image carrier is not transferred to the paper, but is simply collected. In this case, the amount of toner collected and conveyed sharply increases for a moment, so that the toner is apt to overflow the screw pump or bridge therein. To solve this problem, it is necessary to drive the screw pump. In this modification, the cumulative drive time N may be multiplied by a coefficient ⅕ for a moment in order to reduce the drive period of the screw pump, i.e., increase the amount of toner to be conveyed.

While the cleaning device 30 shown in FIG. 1 uses a blade, the blade may, of course, be replaced with a magnet brush or a fur brush.

The illustrative embodiment and its modifications are practicable not only with toner collected from a photoconductive element but also toner collected from an intermediate transfer belt or similar intermediate transfer member intervening between a photoconductive element and a recording medium. That is, the illustrative embodiment and its modifications are applicable not only to a cleaning unit for a photoconductive element, but also for a cleaning unit for an intermediate transfer member. It should therefore be noted that an intermediate image carrier refers to both of a photoconductive element and an intermediate transfer body.

As stated above, the illustrative embodiment and its modifications achieve various unprecedented advantages, as enumerated below.

(1) A collected toner conveying device is capable of solving the problems of conventional toner conveying devices while optimizing the size of the body of an image forming apparatus and providing a cleaning unit with required quality, performance, and function. Specifically, the embodiment and its modifications are free from troubles particular to a toner conveying device of the type using a screw pump and an air pump and conveying a toner and air mixture via an elastic tubing, i.e., the wear of a stator due to aging and a decrease in the delivery pressure of the pump ascribable to the wear. This provides the toner conveying device with durability, reliability and simple construction while insuring toner conveyance and reducing cost.

(2) The screw pump is driven only for a necessary period of time in accordance with the output of means for detecting the operation time of a photoconductive element. This simplifies the construction and reduces the cost of the toner collecting device, enhances the durability of a screw pump for toner collection, saves power, promotes the efficient operation of the screw pump to thereby increase durability, and reduce the running cost (parts cost). Specifically, the screw pump and air pump each is driven only for a minimum necessary period of time in accordance with the operation time of a photoconductive element, the stator and rotor are free from wear and therefore prevents the delivery pressure of the pump from falling.

(2) Exposure adjusting means is provided for adjusting a voltage to be applied to a lamp for exposure. The time when the screw pump should start operating is corrected in accordance with the value adjusted by the exposure adjusting means. The interval between the consecutive operations of the screw pump is adjusted in accordance with the size of the voltage to be applied to the lamp. This successfully enhances accurate decision on the amount of collected toner and increases the efficiency of screw pump drive. This increases the durability of the screw pump and prevents collected toner from overflowing the screw pump or bridging therein due to a temporary increase in the amount of the toner.

(3) When a paper jams a transport path formed in the body of an image forming apparatus, the screw pump is driven continuously or at preselected intervals. This enhances accurate decision on the amount of collected toner, simplifies the construction and reduces the cost of the toner collecting device, and prevents toner from overflowing the screw pump or bridging therein. Specifically, when paper jams the transport path at the upstream side of an image transfer position, a toner conveying device conveys toner collected in a great amount from the photoconductive element by a greater amount.

Figure 8:
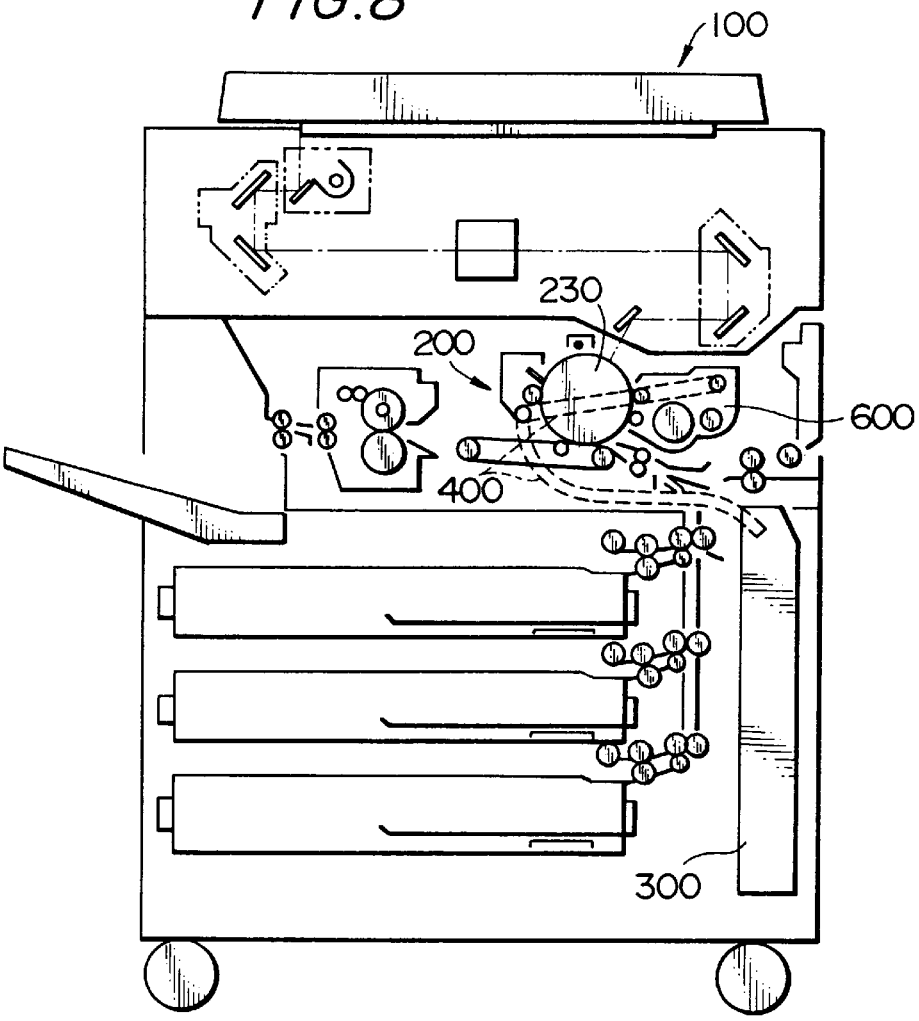
FIG. 8 shows an alternative embodiment of the present invention.

Reference will be made to FIG. 8 for describing an alternative embodiment of the present invention. As shown, a copier 100 includes a cleaning unit 200 also using a cleaning blade by way of example. A tubing 400 communicates the cleaning unit 200 to a developing unit 600 or a collected toner storing device 300 via a collected toner conveying device 500 including a powder pump unit which will be described later. Toner collected from a photoconductive element or drum 230 by the cleaning unit 200 is transferred to the developing unit 600 or the collected toner storing device 300 by the tubing 400. The collected toner storing device 300 is a single unit removably mounted to the copier 100.

Figure 9:
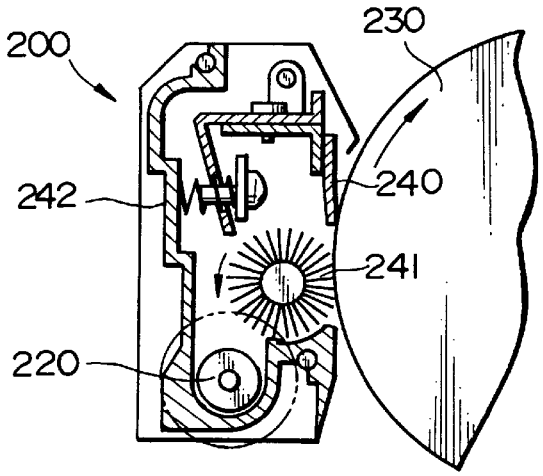
FIG. 9 is a section showing a cleaning unit included in the alternative embodiment.
Figure 10:
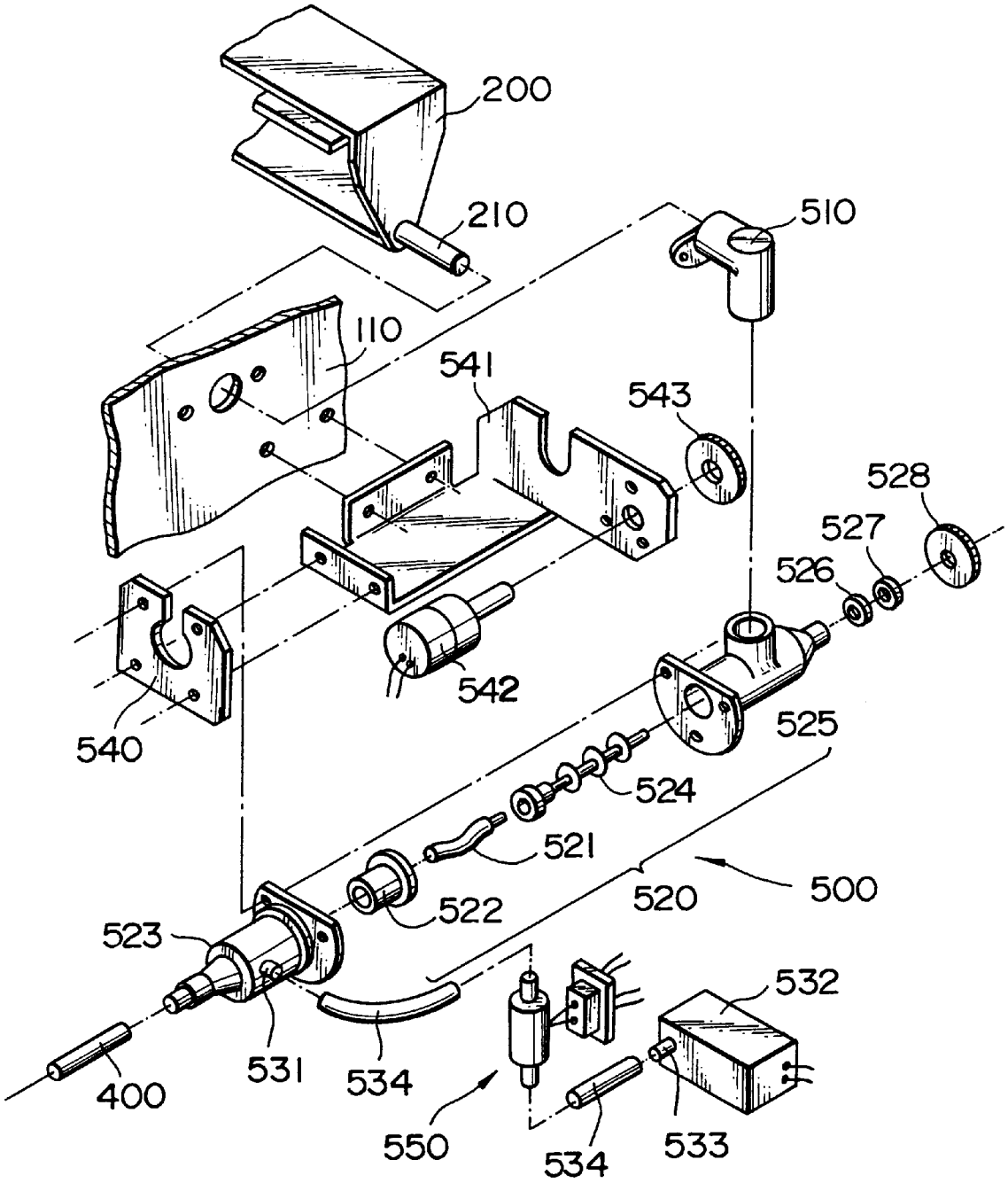
FIG. 10 is an exploded perspective view of a collected toner conveying device included in the alternative embodiment.

As shown in FIGS. 9 and 10, the cleaning unit 200 includes a blade 240 and a brush 241 for removing toner left on the drum 230 after image transfer. The collected toner is introduced into a receptacle 242 playing the role of a structural body of the cleaning unit 200 and the role of a toner guide member at the same time. A collected toner discharge member 220 is positioned at the bottom of the receptacle and transfers the collected toner to a toner receiving portion 510 via a toner discharging section 210. The toner receiving portion 510 forms a part of the collected toner conveying device 500 and is engaged with the toner discharging section 210.

The cleaning unit 200, drum 230, developing unit 600 and collected toner conveying device 500 are mounted on a structural body 110 constituted by the side wall of the copier body.

Figure 11:
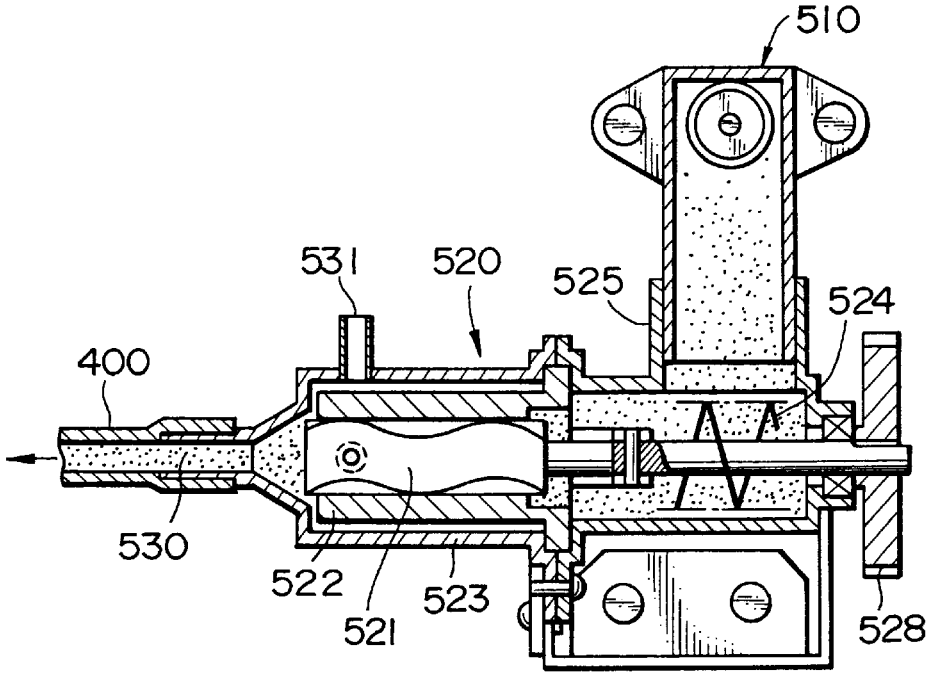
FIG. 11 is a section of a powder pump unit included in the collected toner conveying device of FIG. 10.

A powder pump unit 520 is implemented by a screw pump or Mono pump, as in the previous embodiment. As shown in FIGS. 10 and 11, the powder pump unit 520 is made up of a rotor 521, a stator 522 surrounding the rotor 520 and formed of rubber or similar elastic material, and a holder 523 holding the stator 522. A horizontal screw conveyor 524 has its one end connected to the rotor 521. The other end of the screw conveyor 524 is connected to a driven gear 528 via a seal member 526 and a bearing 527.

The powder pump unit 520 is mounted on a support member 541 by a mount member 540. A drive motor 542 is mounted on the support member 541. A drive gear 543 is mounted on the output shaft of the drive motor 542 and held in mesh with the driven gear 528.

As shown in FIG. 11, a gap of about 1 mm exists between the outer periphery of the stator 522 and the inner periphery of the holder 523 and is communicated to a passageway 530. The holder 523 is formed with an air inlet 531. An air pump 532 is positioned outside of the holder 523 and includes an air outlet 533. The outlet 533 is communicated to the air inlet 531 via a conduit 534 and an air sensor 550. In this configuration, air under pressure is fed from the air pump 532 to the air inlet 531 and therefore to the passageway 530.

The air pump 532 sends compressed air into the collected toner via the air inlet 531 at a rate of 0.5 to 1 litter per minute. As a result, the fluidity of the collected toner to be delivered from the powder pump unit 520 is enhanced. This allows the powder pump unit 520 to more surely convey the collected toner. The collected toner coming out of the powder pump 520 is sent to the developing unit 600 or the collected toner storing device 300 by a tubing 400.

The tubing 400 is implemented by a tube having an inside diameter of, e.g., about 4 mm to 6 mm and a thickness of about 1 mm to 1.5 mm. The tubing 400 does not have to be provided with any member thereinside and can therefore be formed of a flexible material. For example, use may advantageously be made of soft vinyl chloride, nylon or Teflon that is flexible and highly resistive to toner. Because the tubing 60 connecting the copier body and toner replenishing device is flexible, the various units can be laid out with a minimum of limitation. This successfully promotes the effective use of the limited space available in the copier and easy maintenance.

Again, the tubing 400 and the conduit 534 extending from the air pump 532 may each be implemented by a plurality of parts connected together. This configuration facilitates the construction of the individual device into a unit and enhances productivity and easy maintenance.

The distance of conveyance of the collected toner can be freely selected on the basis of the size of the rotor 521, the size of the stator 522, and the rotation speed of the rotor 521. In addition, the collected toner can be conveyed in any desired direction, i.e., upward, downward, rightward or leftward.

Figure 15:
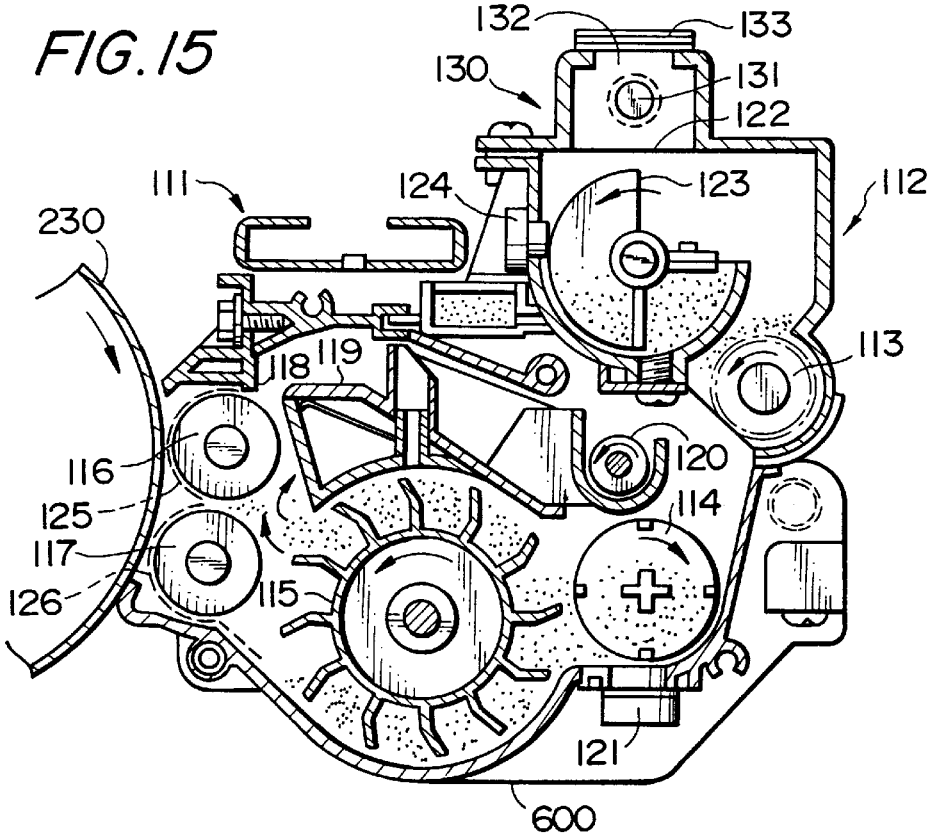
FIG. 15 is a section of a developing device included in the alternative embodiment.

As shown in FIG. 15, the developing unit 600 includes a developing section 111 and a toner replenishing section 112. Again, the developing unit 600 stores a two-ingredient type developer. The developing section 111 has a roller 114 and a paddle wheel 115 serving as agitating members, and a plurality of (two in the illustrative embodiment) developing rollers or developer carriers 116 and 117. A drive section, not shown, causes the roller 114 and paddle wheel 115 to rotate and convey the developer existing in the developing section 111 while agitating it. The agitation charges the toner and carrier of the developer to opposite polarities.

The developing rollers 116 and 117 adjoin the drum 230 and are respectively positioned at the upstream side and downstream side in the direction of rotation of the drum 230. The developing rollers 116 and 117 each is made up of a stationary magnet roller and a sleeve surrounding it and driven by a drive section not shown.

In the developing section 111, the paddle wheel 115 conveys the developer to the developing roller 117. The developing roller 117 magnetically retains the developer thereon and conveys it to the developing roller 16. The developing roller 16 magnetically holds the developer conveyed thereto by the developing roller 117 and paddle wheel 115 and conveys it to a developing position 125 where the roller 116 faces the drum 230. The developer on the developing roller 116 develops a latent image electrostatically formed on the drum 230 when brought to the position 125.

The developing roller 117 faces the drum 230 at a developing position 126. At the position 126, the developer on the developing roller 117 further develops the latent image having been developed by the developer at the position 125. The developer remaining on the developing roller 117 after the development drops into the developing section 111 and is agitated by the paddle wheel 115. A doctor blade 118 scrapes off an excessive part of the developer deposited on the developing roller 116. This part of the developer is guided by a separator 119 to a screw conveyor 120 and dropped onto the roller 114 thereby.

A toner content sensor 121 is positioned in the vicinity of the roller 114 in order to sense the toner content of the developer existing in the developing section 111. The toner replenishing section 112 replenishes toner to the developer present in the developing section 111. The toner replenishing section 112 includes an agitator 123 for agitating the toner, and a replenishing roller 113 driven to replenish the toner to the developing section 111 in accordance with the output of the toner content sensor 121. An opening 122 and a connecting section 130 for the replenishment of collected toner are formed in the upper portion of the toner replenishing section 111.

The collected toner conveyed by the screw pump unit is delivered to the toner replenishing section 112 via the tubing 400 and the connecting section 130 connected to the end of the tubing 400. The toner replenishing section 112 further includes an air filter 132 through which air is discharged. The collected toner is conveyed to the replenishing section 112 by air under pressure. Air is discharged through the air filter 132 in order to prevent pressure inside the toner replenishing section from rising.

A toner end sensor 124 senses the amount of toner remaining in the toner replenishing section 112 in order to detect a toner end condition or a toner near-end condition.

The toner end sensor 124 is implemented by a piezoelectric device responsive to the pressure of toner being replenished from the replenishing section 112 to the developing section 111. When the pressure of the toner stops acting on the toner end sensor 124, the sensor 124 outputs a toner end signal or a toner near-end signal. In response to the toner end or toner near-end signal, toner feeding means, not shown, separate from the developing device feeds fresh toner to the replenishing section 112.

Figure 16:
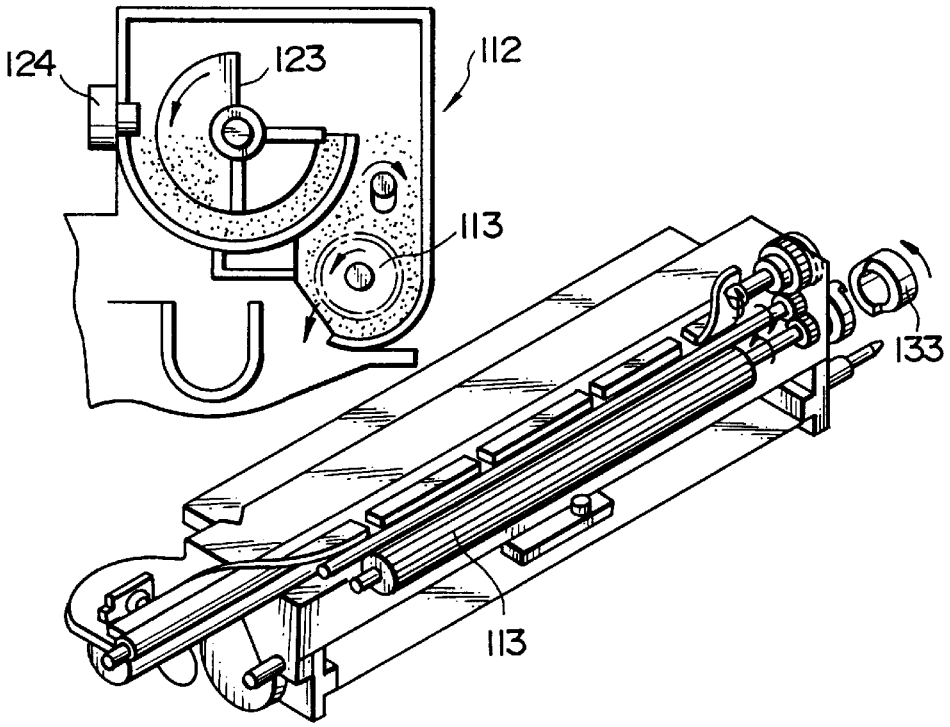
FIG. 16 is a fragmentary exploded perspective view of the developing device shown in FIG. 15.

As shown in FIG. 16, the agitator 123 is rotated via a gearing when a replenishing clutch 133 is coupled. The agitator 123 conveys the toner from the front to the rear in the direction perpendicular to the sheet surface of FIG. 6 to the replenishing roller 113. The replenishing roller 113 is formed with grooves for conveying the toner.

In the illustrative embodiment, a main control board included in the copier 100 determined whether or not the toner replenishing section 112 has replenished a preselected amount of toner to the developing section 111, i.e., whether or not the replenishing clutch has been repeatedly turned on a preselected number of times or over a preselected period of time. If the answer of this decision is positive, then the main control board sends signals to the drive motor 542 and air pump 532 in order to convey the collected toner. At this instant, the main control board turns on only the air pump 532 at the time for driving the drive motor 542, then turns on the drive motor 542 on the elapse of several seconds, and then turns off the motor 542 while causing only the air pump 532 to continuously operate for several more seconds. Such a procedure will be described more specifically later.

Now, while the powder pump unit 520 is operation, the collected toner substantially uniformly mixed with air fills substantially the entire tubing 400. If the entire copier, i.e., the powder pump unit 520 and air pump 532 are turned off at the same time, then only air contained in the toner and air mixture filling the tubing 400 flows out. As a result, the toner drops due to its own weight and increases its density within the tubing 400.

In the above condition, when the powder pump unit 520 is again operated to deliver the collected toner, it is likely that the dense toner existing in the tubing 400 blocks the toner newly coming into the tubing 400. Consequently, the powder pump unit 520 locks or causes the collected toner to stick to the rotor 521 due to excessive temperature elevation. The toner stuck to the rotor 521 shaves off the stator 522 and thereby damages the powder pump unit 520.

By contrast, when only the air pump 532 is driven before the start of operation of the powder pump unit 520, the dense toner existing in the tubing 400 is driven out by air. Alternatively, only the air pump 532 may be driven after the stop of operation of the powder pump unit 520 in order to substantially evacuate the tubing 400. In this manner, the tubing 400 is prevented from being stopped and can surely convey the collected toner.

Figure 12:
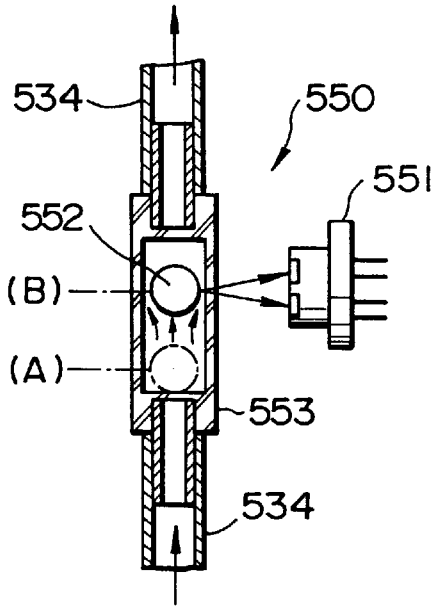
FIG. 12 is a section showing an air sensor associated with the powder pump unit of FIG. 11.
Figure 13:
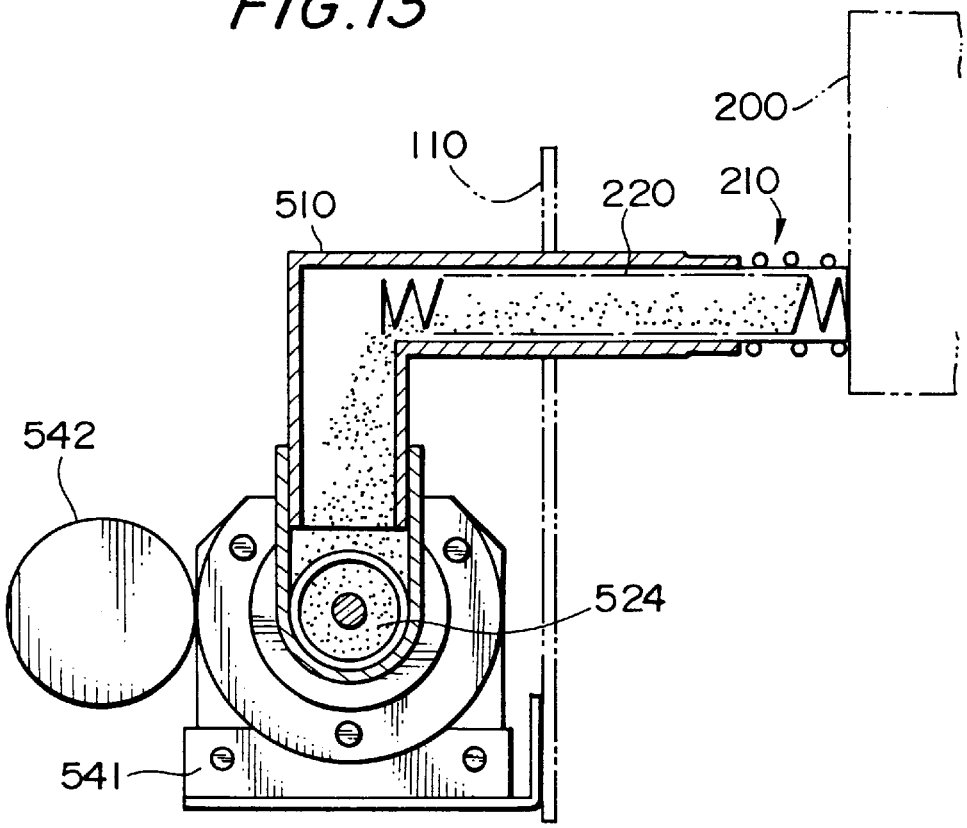
FIG. 13 is a fragmentary section of the collected toner conveying device of FIG. 10.
Figure 14:
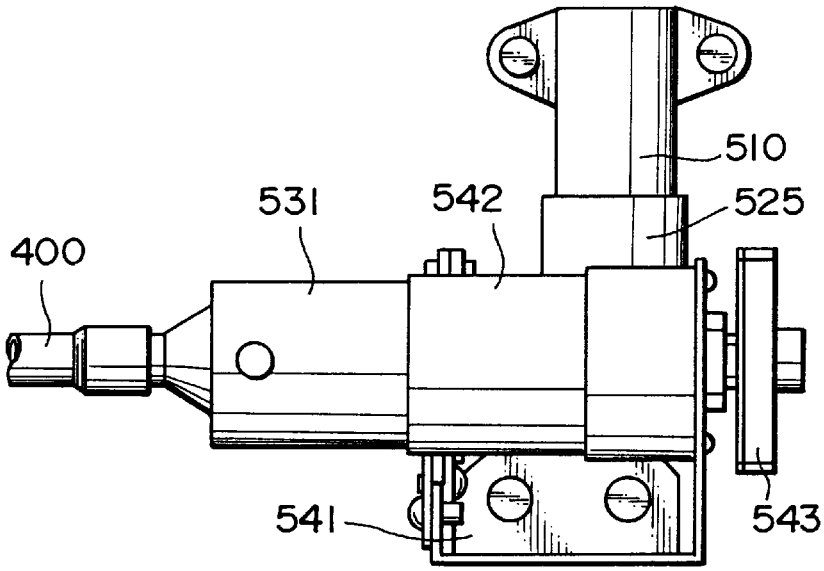
FIG. 14 is a front view of the collected toner conveying device shown in FIG. 10.

FIG. 12 shows the configuration of the air sensor 550 specifically. The prerequisite with the above conveyance using the powder pump unit 520 is that the collected toner be conveyed together with air from the reliability standpoint, as stated earlier. The air sensor 550 is used to determine whether or not air is being adequately fed from the air pump 532 to the powder pump unit 520. The air sensor 550 plays the role of a safety device for minimizing the system-down of the toner collecting device.

The air sensor 550 has a transparent tubular container 553 and a float 552 sealed in the container 553 in such a manner as to be movable up and down. When the air pump 532 is operated to deliver compressed air via the air sensor 550 in the direction indicated by an arrow in FIG. 12, it raises the float 552 from a position (A) to a position (B). A sensor 551 senses the float 552 brought to the position (B) and shows that air is being adequately sent from the air pump 532 to the powder pump unit 520.

Assume that the float 552 is absent at the posit ion (B) despite the operation of the air pump 532, as determined by the sensor 551. Then, a controller, not shown, determines that some error has occurred in the delivery of air from the air pump 532 to the powder pump unit 520, and stops the operation of the copier 100 while displaying an error message on the copier 100.

While the float 552 of the illustrative embodiment is implemented by a ball formed of resin or stainless steel or similar metal, it may, of course, be implemented by any other suitable member and formed of any other suitable material. Also, while the sensor 551 of the embodiment is sensitive to reflected light, use may be made of a transmission type sensor or a magnetic sensor, if desired. As shown in FIG. 10, the drive motor 542 is used to drive the powder pump unit 520. Alternatively, the powder pump unit 520 may be connected to the driveline of the copier 100 via, e.g., a clutch for further reducing the size, simplifying the construction, and lowering the cost of the copier 100.

To convey a greater amount of collected toner, it has been customary to increase the size of a coil screw and that of a tubing and to increase the rotation speed of the coil screw. Further, to increase the distance of conveyance, it has been customary to connect a plurality of coil screws and tubes. This, however, increases the number of parts and cost, degrades reliability, maintenance and productivity, increases the size of a conveying device and therefore the overall size of the copier body, and increases the area to be occupied by the copier.

By contrast, in the illustrative embodiment, the flexible tubing should only be connected to the developing device 600 or the collected toner storing device 300, so that the toner collecting device can be implemented as a miniature independent unit. The toner collecting device can therefore be mounted to the copier body with a minimum of limitation and reduces the area to be allocated to the copier body. In addition, such a toner collecting device enhances the productivity of the copier body and easy maintenance.

Moreover, the collected toner is conveyed via the tubing 400 together with compressed air. This substantially frees the collected toner from mechanical stresses and frees the tubing from drive loads. The toner collecting device is therefore capable of surely conveying the collected toner and free from limitations relating to the distance and direction of conveyance. In addition, the above embodiment enhances the reliability and durability of the toner collecting device, simplifies the configuration of the toner collecting device, and reduces the drive load and therefore power consumption and cost.

Figure 17:
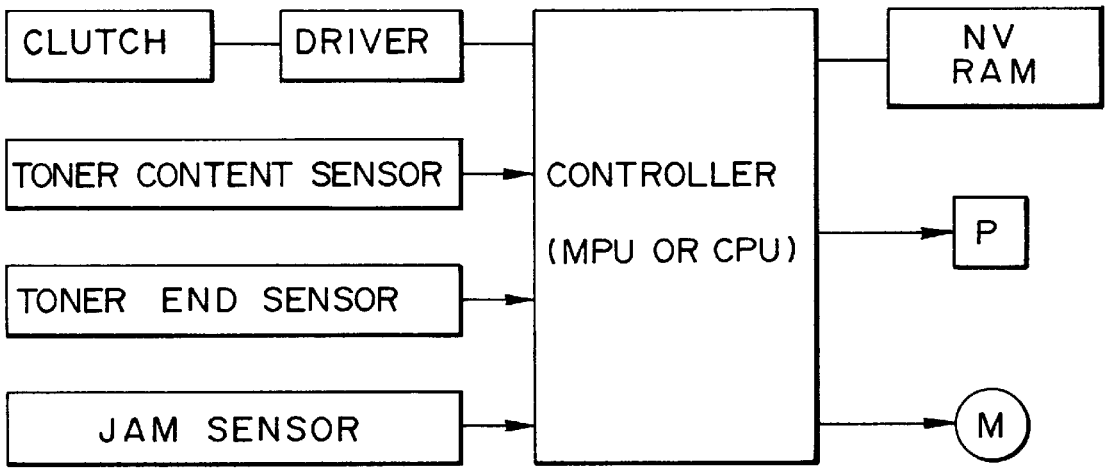
FIG. 17 is a schematic block diagram showing a control system included in the alternative embodiment.

FIG. 17 shows a control system for executing the above control. As shown, a controller including an MPU or a CPU controls the toner collecting device. The MPU sends, based on the output of the toner content sensor, a control signal to the replenishing clutch via a driver, thereby causing the toner replenishing section to replenish toner to the developing section. Every time the MPU sends such a control signal, it increments a counter included therein by 1 (one). When the counter reaches a preselected value, the MPU clears the counter and drives the drive motor and air pump labeled M and P, respectively. The MPU has a timer function and is capable of controlling each of the drive motor M, air pump P and so forth at any desired timing. Again, an NV RAM should preferably be provided for preventing the value of the counter from being cleared when the power supply is shut off.

Figure 18:
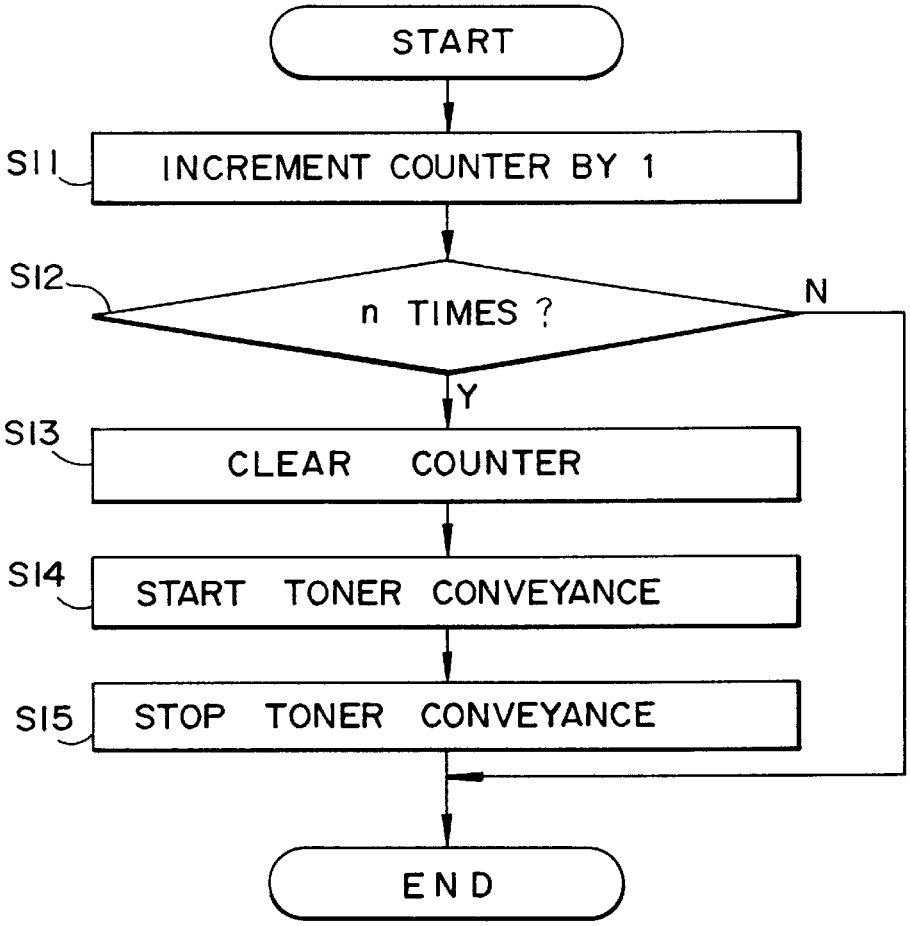
FIG. 18 is a flowchart demonstrating a specific operation of the control system of FIG. 17.

FIG. 18 shows a specific control over the toner collecting device executed by the MPU. As shown, when the MPU sends a control signal to the replenishing clutch for causing it to replenish toner, steps S11–S14 are executed. The procedure represented by the steps S11–S14 has already been described. It is to be noted that toner conveyance (step S14) continues from the start to the end of operation of the air pump and the start to the end of operation of the screw pump.

Figure 19:
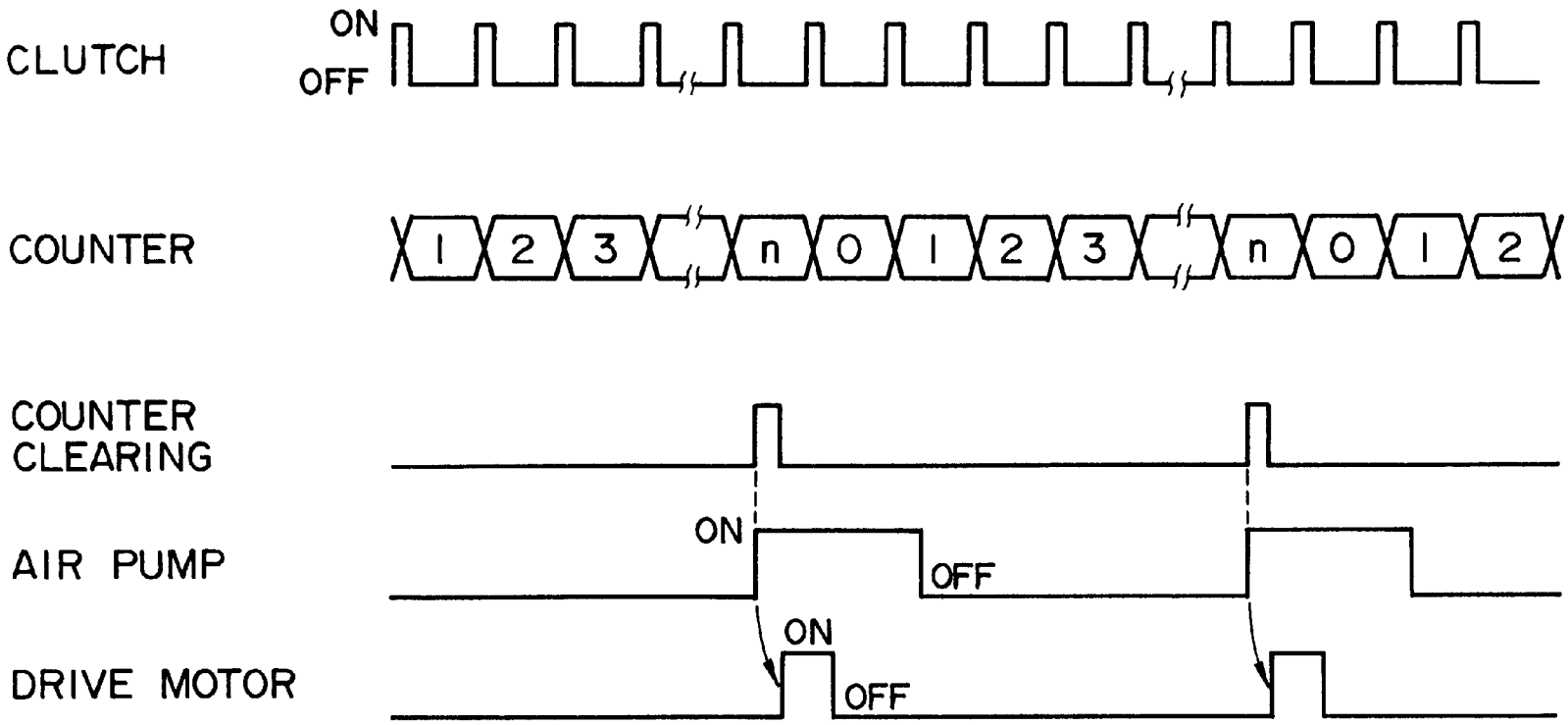
FIG. 19 is a timing chart showing the operating timing of a drive motor and that of an air pump included in the alternative embodiment.

FIG. 19 shows specific control over the powder pump unit and air pump in detail. As shown, when the replenishing clutch 133 is repeatedly turned on a preselected number of times n by the control signals, the MPU drives the air pump for toner collection. Then, on the elapse of a preselected period of time (e.g. 0.5 second), the MPU drives the drive motor for toner collection. Further, on the elapse of a preselected period of time (e.g. 4 seconds) since the stop of drive of the motor, the MPU causes the air pump to stop operating. As a result, air can discharge the toner remaining in the tubing 60 alone, as stated earlier.

The above value n can be adequately selected by calculation. Specifically, the amount of toner collected from the drum (main motor) is determined on the basis of the amount of toner to be replenished by a single coupling of the replenishing clutch, an image transfer ratio, etc. The ratio of the amount (ability) of toner conveyance effected by a single drive of the screw pump unit to the above amount of toner collected from the drum is the value n to be set although it depends on the duration of a single drive.

The MPU determines whether or not a toner end condition has been reached on the basis of the output of the toner end sensor. If the answer of the this decision is positive and if image formation is under way, the MPU causes the screw pump and air pump to operate at preselected intervals (toner end mode). Specifically, because no toner is replenished in the toner end condition, the MPU does not cause the collected toner conveying device to operate on the basis of the number of times of toner replenishment effected. However, should the screw pump and air pump be not operated, the toner collected from the cleaning means during image formation would overflow the collected toner conveying device.

As for the above interval between the consecutive operations of the collected toner conveying device, assume that the amount of collected toner is the product of the image ratio of a document, the amount of toner to deposit on a black solid image for a unit area, the area of a paper, (1−image transfer ratio), and the number of copies produced for a unit time. Then, the interval should preferably be the ratio of the amount of toner (ability) to be conveyed by a single drive of the screw pump to the amount of collected toner although it depends on the duration of a single drive of the screw pump. The image ratio of a document may be 6% to 30% as customarily used. Also, a paper may be a paper of size A4.

It is a common practice with an image forming apparatus to arrange jam sensors for detecting paper jams. However, when a paper jams a transport path at the upstream side of an image transfer position, toner deposited on an image carrier is not transferred to the paper, but is simply collected. In this case, because the amount of toner collected and conveyed sharply increases for a moment, the screw pump is driven. Alternatively, the value n may be multiplied by a coefficient ⅕ for a moment in order to reduce the drive period of the screw pump.

While the cleaning device 200 shown in FIG.8 uses a blade, the blade may, of course, be replaced with a magnet brush or a fur brush. The illustrative embodiment is practicable not only with toner collected from a photoconductive element but also toner collected from an intermediate transfer belt or similar intermediate transfer member intervening between a photoconductive element and a recording medium. That is, the illustrative embodiment is applicable not only to a cleaning unit for a photoconductive element, but also to a cleaning unit for an intermediate transfer member.

In the illustrative embodiment, each of the toner feeding and collecting devices should only be connected to the machine body by a respective tubing and a cable for control and can therefore be constructed into a unit independent of the machine body. This promotes the efficient use of a space and enhances productivity and maintenance.

As stated above, the above embodiment has various unprecedented advantages, as enumerated below.

(1) A toner collecting device is simple in construction and can surely convey collected toner. The device is therefore reliable, durable, and low cost.

(2) A screw pump is efficiently driven and therefore durable. In addition, the screw pump is intermittently driven in order to prevent the temperature of the toner being conveyed from rising. This prevents the toner from blocking in and around the screw pump or powder pump.

(3) During the intermittent drive of the screw pump, there can be implemented the sure conveyance of the toner and improvement in the durability of air feeding means.

(4) The collected toner in the powder pump is prevented from overflowing or bridging even when the amount of collected toner increases for a moment.

Various modifications will become possible for those skilled in the art after receiving the teachings of the present disclosure without departing from the scope thereof.

What is claimed is:

1. An image forming apparatus including an image carrier and capable of recycling toner, comprising:

a screw pump including a female screw type stator formed with a spiral groove in an inner periphery thereof and a male screw type rotor rotatably received in said stator;

air feeding means for scattering and thereby fluidizing collected toner to be delivered from said screw pump via a tubing;

first drive means for selectively starting or stopping driving said screw pump independently of the image carrier;

a timer for counting a cumulative operation time of the image carrier; and control means for controlling, based on the cumulative operation time, an operation of said screw pump and an operation of said air feeding means.

2. An apparatus as claimed in claim 1, wherein said control means causes each of said screw pump and said air feeding means to operate continuously or at preselected intervals when a recording medium jams a paper transport path formed in said apparatus.

3. An apparatus as claimed in claim 1, further comprising:

a lamp for electrostatically forming a latent image representative of a document image on the image carrier; and exposure adjusting means for adjusting a voltage to be applied to said lamp;

said control means correcting a drive timing of said screw pump and a drive timing of said air feeding means in accordance with the voltage adjusted by said exposure adjusting means.

4. An apparatus as claimed in claim 3, wherein said control means causes each of said screw pump and said air feeding means to operate continuously or at preselected intervals when a recording medium jams a paper transport path formed in said apparatus.

5. An apparatus as claimed in claim 1, wherein the toner to be recycled is collected from a cleaning unit of at least one of the image carrier and a recording medium conveying member and then transferred to toner replenishing means of at least one of a collected toner storing device and a developing device.

6. An apparatus as claimed in claim 5, further comprising toner sensing means for sensing an amount of toner replenished from said toner replenishing means to said developing device, said control means controlling the operation of said screw pump in accordance with an output of said toner sensing means.

7. An apparatus as claimed in claim 6, wherein said control means causes said screw pump to start operating when said toner replenishing means is repeatedly operated a preselected number of times or over a preselected period of time.

8. An apparatus as claimed in claim 6, wherein said toner sensing means senses a period of time over which a toner replenishing clutch is turned on.

9. An apparatus as claimed in claim 6, further comprising second drive means for selectively starting or stopping driving said air feeding means.

10. An apparatus as claimed in claim 6, wherein said control means starts driving, at a time for starting driving said screw pump, said air feeding means before said screw pump and stops driving, at a time for stopping driving said screw pump, said air feeding means after said screw pump.

11. An apparatus as claimed in claim 6, further comprising toner end sensing means for sensing an amount of toner remaining in said toner replenishing means, wherein when said toner end sensing means senses a toner end condition during image formation, said control means sets up a toner end mode for driving said screw pump at preselected intervals.

12. An apparatus as claimed in claim 6, wherein said control means causes said screw pump to operate continuously or at preselected intervals when a recording medium jams a paper transport path formed in said apparatus.

* * * * *